US009881496B2

(12) United States Patent
Chen et al.

(10) Patent No.: US 9,881,496 B2
(45) Date of Patent: Jan. 30, 2018

(54) REMOTE CONTROL SYSTEM ELECTRONIC DEVICE AND REMOTE CONTROL METHOD

(71) Applicant: Acer Incorporated, New Taipei (TW)

(72) Inventors: Cheng-Hung Chen, New Taipei (TW); Chao-Kuang Yang, New Taipei (TW); Wen-Cheng Hsu, New Taipei (TW); Shih-Hao Lin, New Taipei (TW); Chia-Hsun Lee, New Taipei (TW); Chi-Hung Chang, New Taipei (TW); Tzu-Kang Huang, New Taipei (TW); Chen-Hsiang Ko, New Taipei (TW); Chi-Sheng Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/365,148

(22) Filed: Nov. 30, 2016

(65) Prior Publication Data

US 2017/0186311 A1 Jun. 29, 2017

(30) Foreign Application Priority Data

Dec. 29, 2015 (TW) ..... 104144177 A

(51) Int. Cl.
*G08C 17/02* (2006.01)
*G08C 17/00* (2006.01)
*G08C 23/04* (2006.01)

(52) U.S. Cl.
CPC ..... *G08C 17/02* (2013.01); *G08C 17/00* (2013.01); *G08C 23/04* (2013.01);
(Continued)

(58) Field of Classification Search
CPC .... G08C 17/02; G08C 23/04; G08C 2201/40; G08C 2201/93; G08C 2201/42; G08C 2201/92; G08C 17/00; H04L 12/2803
(Continued)

(56) References Cited

U.S. PATENT DOCUMENTS 9,547,980 B2 * 1/2017 Chen ..... G08C 17/02
2004/0010561 A1 1/2004 Kim et al.
(Continued)

FOREIGN PATENT DOCUMENTS

CN 102208130 A 10/2011
CN 102843315 A 12/2012
(Continued)

OTHER PUBLICATIONS

Chinese language office action dated Feb. 17, 2017, issued in application No. TW 104144177.
(Continued)

*Primary Examiner* — Ali Neyzari
(74) *Attorney, Agent, or Firm* — McClure, Qualey & Rodack, LLP

(57) ABSTRACT

The invention provides a remote control system, including a cloud server, a first device and a portable electronic device. The first device includes a transmission interface for connecting to a second device. The portable electronic device sets up a transmission path to connect with the first device via the cloud server. The first device transmits type information including a type of the transmission interface to the portable electronic device through the transmission path. The portable electronic device encodes original data based on the type information to generate encoded data conforming to the transmission interface, and transmits the encoded data to the first device through the transmission path. The first device transmits the encoded data to the second device through the transmission interface, so as to control the second device.

13 Claims, 3 Drawing Sheets

(52) U.S. Cl.
CPC ..... *G08C 2201/40* (2013.01); *G08C 2201/42* (2013.01); *G08C 2201/93* (2013.01)

(58) Field of Classification Search
USPC ..... 340/12.5
See application file for complete search history.

(56) References Cited

U.S. PATENT DOCUMENTS

| | | | | |
|---|---|---|---|---|
| 2014/0064738 | A1 | 3/2014 | Chen et al. | |
| 2014/0118120 | A1 | 5/2014 | Chen et al. | |
| 2015/0241079 | A1* | 8/2015 | Matsuoka | H04L 12/2825 700/276 |

FOREIGN PATENT DOCUMENTS

| | | | |
|---|---|---|---|
| TW | M456647 | U | 7/2013 |
| TW | M505754 | U | 7/2015 |
| TW | 201545064 | A | 12/2015 |

OTHER PUBLICATIONS

Chinese language office action dated Aug. 14, 2017, issued in application No. TW 104144177.

* cited by examiner

REMOTE CONTROL SYSTEM ELECTRONIC DEVICE AND REMOTE CONTROL METHOD

CROSS REFERENCE TO RELATED APPLICATIONS

This Application claims priority of Taiwan Patent Application No. 104144177, filed on Dec. 29, 2015, the entirety of which is incorporated by reference herein.

BACKGROUND OF THE INVENTION

Field of the Invention

The present invention relates to a control system, an electronic device and a remote control method, and in particular to a control system, an electronic device and a remote control method using wireless technology.

Description of the Related Art

Internet of Things (TOT) allows all products (things) in our life to be equipped with sensing technology, and the products have the ability to connect to the Internet. For example, refrigerators, cars, air conditioners, and dehumidifiers can connect to the internet, and collect data at any time for actively providing user with necessary information at the appropriate time.

At present, an electronic product capable of connecting to the Internet is equipped with a wireless module, and the electronic product connects to the Internet using a local area network (LAN) in the user's house. The user can use a portable electronic device, such as a smartphone, to execute a corresponding application to connect to the electronic product and control the operation of the electronic product.

However, the user may have other electronic products in his house that cannot connect to the Internet. If the user wants all his electronic products to be able to connect to the Internet, the user has to replace his existing electronic products which cannot connect to the Internet with new electronic products which can connect to the Internet, and discard the existing electronic products which cannot connect to the Internet, resulting in a waste of electronic products.

Therefore, the development of a system and an electronic device that helps electronic products which were originally designed not to connect to the Internet to achieve that purpose is an important issue.

BRIEF SUMMARY OF THE INVENTION

A detailed description is given in the following embodiments with reference to the accompanying drawings.

The invention provides a remote control system, including a cloud server, a first device and a portable electronic device. The first device includes a transmission interface for connecting to a second device. The portable electronic device sets up a transmission path to connect with the first device via the cloud server. The first device transmits type information including a type of the transmission interface to the portable electronic device through the transmission path. The portable electronic device encodes original data based on the type information to generate encoded data conforming to the transmission interface, and transmits the encoded data to the first device by the transmission path. The first device transmits the encoded data to the second device through the transmission interface, so as to control the second device.

According to the disclosure, the invention discloses an electronic device, including a transmission interface, a microcontroller and a wireless transmission module. The transmission interface is for connecting to an external device. The microcontroller is connected to the transmission interface. The wireless transmission module is for setting up a transmission path to connect with a portable electronic device. The wireless transmission module transmits type information including a type of the transmission interface to the portable electronic device by the transmission path, receives encoded data conforming to the transmission interface from the portable electronic device by the transmission path, and the microcontroller transmits the encoded data to the external device, so as to control the external device, wherein the portable electronic device encodes original data based on the type information to generate the encoded data.

According to disclosure, the invention discloses a remote control method, applied to a first device, a second device and a portable electronic device, and the remote control method includes connecting the first device and the portable electronic device to a cloud server; setting up a transmission path between the first device and the portable electronic device; connecting the first device to the second device through a transmission interface of the first device; transmitting type information including a type of the transmission interface to the portable electronic device through the transmission path by the first device; encoding original data based on the type information to generate encoded data conforming to the transmission interface by the portable electronic device; transmitting the encoded data to the first device through the transmission path by the portable electronic device; transmitting the encoded data to the second device through the transmission interface by the first device; and controlling the second device according to the encoded data.

The present invention provides the remote control system which includes a first device and a second device. When the user connects the first device to the second device, the second device, which originally could not connect to the Internet, can receive or transmit information to the cloud server with assistance of the first device. The second device can be an electronic product which cannot connect to the Internet in the user's house. The user can use the portable electronic device to execute the first application and the second application to send corresponding encoded data to the first device, so as to control the second device. As a result, it achieves the purpose of remote control. Therefore, the present invention solves the problem wherein electronic products which cannot connect to the Internet have to be discarded and replaced with new electronic products capable of connecting to the Internet, resulting in unnecessary waste.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
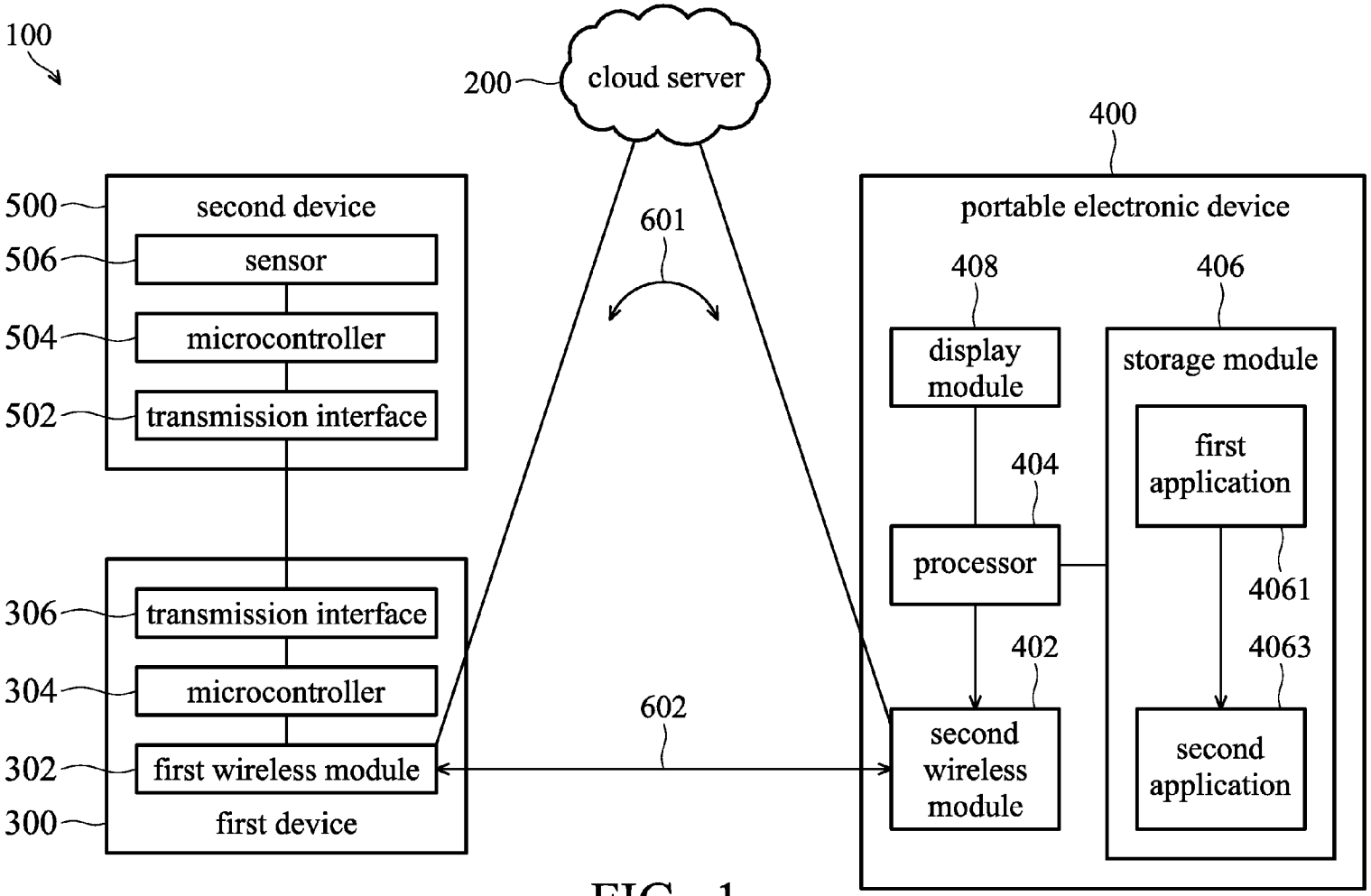
FIG. 1 is a block diagram of a remote control system according to an embodiment of the present invention.

Please refer to FIG. 1, which is block diagram of a remote control system 100 according to an embodiment of the present invention. The remote control system 100 includes a cloud server 200, a first device 300, a portable electronic device 400 and a second device 500. The first device 300 and the portable electronic device 400 can connect to the cloud server 200 through a connecting communication network, such as through any wired or wireless communication network (the Internet, the 3G network and/or wireless local area network (WLAN) and so on). Furthermore, the first device 300 and the portable electronic device 400 can communicate to each other and transmit data to each other through the communication network. The portable electronic device 400 can be a personal digital assistant (PDA), a smartphone, a tablet, a mobile phone, a mobile Internet device (MID), a notebook computer, a car computer, a gaming device or any other type of mobile computing device. However, it will be understood by a person skilled in the art that the present invention is not limited to those devices.

The first device 300 can include a first wireless module 302, a microcontroller 304 and a transmission interface 306. The first wireless module 302 can be a wireless communication module, a second-generation mobile communication module, a third-generation mobile communication module, a fourth-generation mobile communication module, or a fifth-generation mobile communication module for supporting the corresponding protocol, such as Wi-Fi (IEEE 802.11 a/b/g/n), Global System for Mobile Communications (GSM), Enhanced Data rates for GSM Evolution (EDGE), Code Division Multiple Access (CDMA), High Speed Downlink Packet Access (HSDPA), and Worldwide Interoperability for Microwave Access (WiMAX). The first device 300 can connect to the cloud server 200 by the first wireless module 302, and can use login information to log in to the cloud server 200 so as to access a cloud resource of the cloud server 200. The login information includes a login account and a login password corresponding to the login account. When the first device 300 is logged in to the cloud server 200, the first device 300 can store related information of the first device 300 in the cloud resource. For example, the related information of the first device 300 can include an Internet Protocol Address (IP Address) and a Media Access Control Address (MAC Address) for the first device 300.

The microcontroller 304 can be an integrated chip, and can include a central processor, memory, timer/counter, and an input and output interface integrated therein. The microcontroller 304 has the advantages of a simple input and output interface and a small size. The transmission interface 306 is coupled to the microcontroller 304 and transmits data to the microcontroller 304. The transmission interface 306 can include several connection ports, such as a RS232 port, a serial peripheral interface bus (SPI) port, an inter-integrated circuit ($I^2C$) port, and/or a universal serial bus (USB) port.

The second device 500 can be a household electronic product, such as an air conditioner, a television, a dehumidifier, a stereo, a fan, and so on. The second device 500 includes a transmission interface 502, and the transmission interface 502 can be one of the RS232 port, the serial peripheral interface bus (SPI) port, the inter-integrated circuit ($I^2C$) port, and the universal serial bus (USB) port mentioned before. For example, when the transmission interface 502 includes the RS232 port, the second device 500 can connect to a RS232 port of the transmission interface 306 of the first device 300, so that the first device 300 and the second device 500 can transmit data to each other. The second device 500 can further include a microcontroller 504 and a sensor 506. The sensor 506 can be used for detecting device information (such as the temperature or humidity), and the microcontroller 504 can output the device information through the transmission interface 502.

The portable electronic device 400 can include a second wireless module 402, a processor 404, a storage module 406 and a display module 408. The second wireless module 402 can be a wireless communication module, a second-generation mobile communication module, a third-generation mobile communication module, a fourth-generation mobile communication module, or a fifth-generation mobile communication module for supporting the corresponding protocol, such as Wi-Fi (IEEE 802.11 a/b/g/n), Global System for Mobile Communications (GSM), Enhanced Data rates for GSM Evolution (EDGE), Code Division Multiple Access (CDMA), High Speed Downlink Packet Access (HSDPA), and Worldwide Interoperability for Microwave Access (WiMAX). The portable electronic device 400 can connect to the cloud server 200 by second wireless module 402, and uses the login information to log in to the cloud server 200 so as to access the cloud resource of the cloud server 200. Therefore, the first device 300 and the portable electronic device 400 can use the same login information to log in to the cloud server 200 so as to access the same cloud resource.

The storage module 406 can be a Random Access Memory (RAM), a flash memory, a Read-Only Memory (ROM), an Erasable Programmable Read Only Memory (EPROM), an Electrically-Erasable Programmable Read-Only Memory (EEPROM), a register, a hard drive, a portable hard drive, a Compact Disc Read-Only Memory (CD-ROM) or another medium capable of being read by other computers. The processor 404 is coupled to the storage module 406. The processor 404 executes a first application 4061 and a second application 4063, and displays information related to the first application 4061 and the second application 4063 on the display module 408. The display module 408 can be a liquid-crystal display (LCD) module or a touch display module. In this embodiment, the second application 4063 can be set to be executed on the background when the portable electronic device 400 turns on, but is not limited thereto.

When the portable electronic device 400 is logged in to the cloud server 200 and accesses the cloud resource, the portable electronic device 400 can obtain the related information of the first device 300, such as the Internet Protocol Address (IP Address) and the Media Access Control Address (MAC Address), so as to set up a transmission path with the first device 300. The transmission path can be a first transmission path 601 implemented between the portable electronic device 400 and the first device 300 via the cloud server 200 or a second transmission path 602 implemented between the portable electronic device 400 and the first device 300 by peer to peer (P2P) technology.

When the first device 300 connects to the transmission interface 502 of the second device 500 by the transmission interface 306 at the first time, the microcontroller 304 detects a type of the transmission interface 502 of the second device 500, such as the RS232 port. Then, type information including the type of the transmission interface 502 is transmitted to the portable electronic device 400 through the transmission path.

When the portable electronic device 400 executes the first application 4061, the processor 404 controls the display module 408 to display a user interface corresponding to the first application 4061. The user interface displays various buttons, such as ON, OFF, Temperature UP, Temperature Down, Setup, and so on. When the button is pressed, such as the user pressing the ON button, the first application 4061 generates original data, and transmits the original data to the second application 4063 in inter process communication format (IPC format), and the second application 4063 encodes the original data into encoded data conforming to the transmission interface 502 according to the type information of the transmission interface 502. The encoded data corresponds to the control commands of the second device 500, such as a "power on" operation, so as to control the operation of the second device 500. The processor 404 controls the second wireless module 402 to transmit the encoded data to the first device 300 through the second transmission path 602.

The microcontroller 304 of the first device 300 receives the encoded data by the first wireless module 30. Because the encoded data conforms to the format of the transmission interface 306 and the transmission interface 502 (such as RS232), the microcontroller 304 does not need to process the encoded data (such as transforming format of data), and the microcontroller 304 can directly transmit the encoded data to the second device 500 through the transmission interface 306. Because the encoded data corresponds to one of the control commands of the second device 500, the microcontroller 504 of the second device 500 operates accordingly (such as turning on the second device 500) after receiving the encoded data by the transmission interface 502. Therefore, it can achieve the purpose of using the portable electronic device 400 to remotely control the second device 500.

Furthermore, when the transmission path is the first transmission path 601, the second application 4063 further transforms the encoded data to a cloud encoded data in JavaScript Object Notation (JSON) format or eXtensible Markup Language (XML) format, so that the cloud encoded data in JSON format or XML format can be transmitted to the first device 300 by the cloud server 200. After the microcontroller 304 of the first device 300 receives the cloud encoded data by the first wireless module 302, the microcontroller 304 decodes the cloud encoded data to the encoded data, and then the microcontroller 304 transmits the encoded data to the second device 500 through the transmission interface 502 and the transmission interface 306. After the microcontroller 504 of the second device 500 receives the encoded data, the microcontroller 504 operates accordingly.

In addition, the device information, including the temperature or humidity sensed by the sensor 506 of the second device 500, is transmitted to the microcontroller 504, and the microcontroller 504 encodes the device information into encoded device information according to the type information of the transmission interface 502. Then the transmission interface 502 transmits the encoded device information to the transmission interface 306 of the first device 300. After the microcontroller 304 receives the encoded device information through the transmission interface 306, the microcontroller 304 controls the first wireless module 302 to output the encoded device information. The first wireless module 302 transmits the encoded device information to the second wireless module 402 of the portable electronic device 400 through the second transmission path 602. Then, the processor 404 executes the second application 4063 to transform the encoded device information to original device information, and the second application 4063 transmits the original device information to first application 4061 in inter process communication format (IPC format). The processor 404 controls the display module 408 to display the original device information (such as temperature) on the user interface.

Moreover, if it is desired that the encoded device information is transmitted to the portable electronic device 400 through the first transmission path 601, the microcontroller 304 further transforms the encoded device information into cloud encoded device information in JSON format or XML format. Then, the microcontroller 304 controls the first wireless module 302 to output the cloud encoded device information. The first wireless module 302 transmits the cloud encoded device information to the second wireless module 402 of the portable electronic device 400 through the first transmission path 601. Then, the processor 404 executes the second application 4063 transforms the cloud encoded device information to the encoded device information, and further decodes the encoded device information to the original device information. The second application 4063 transmits the original device information to first application 4061 in inter process communication format (IPC format). The processor 404 controls the display module 408 to display the original device information (such as temperature) on the user interface.

Figure 2A:
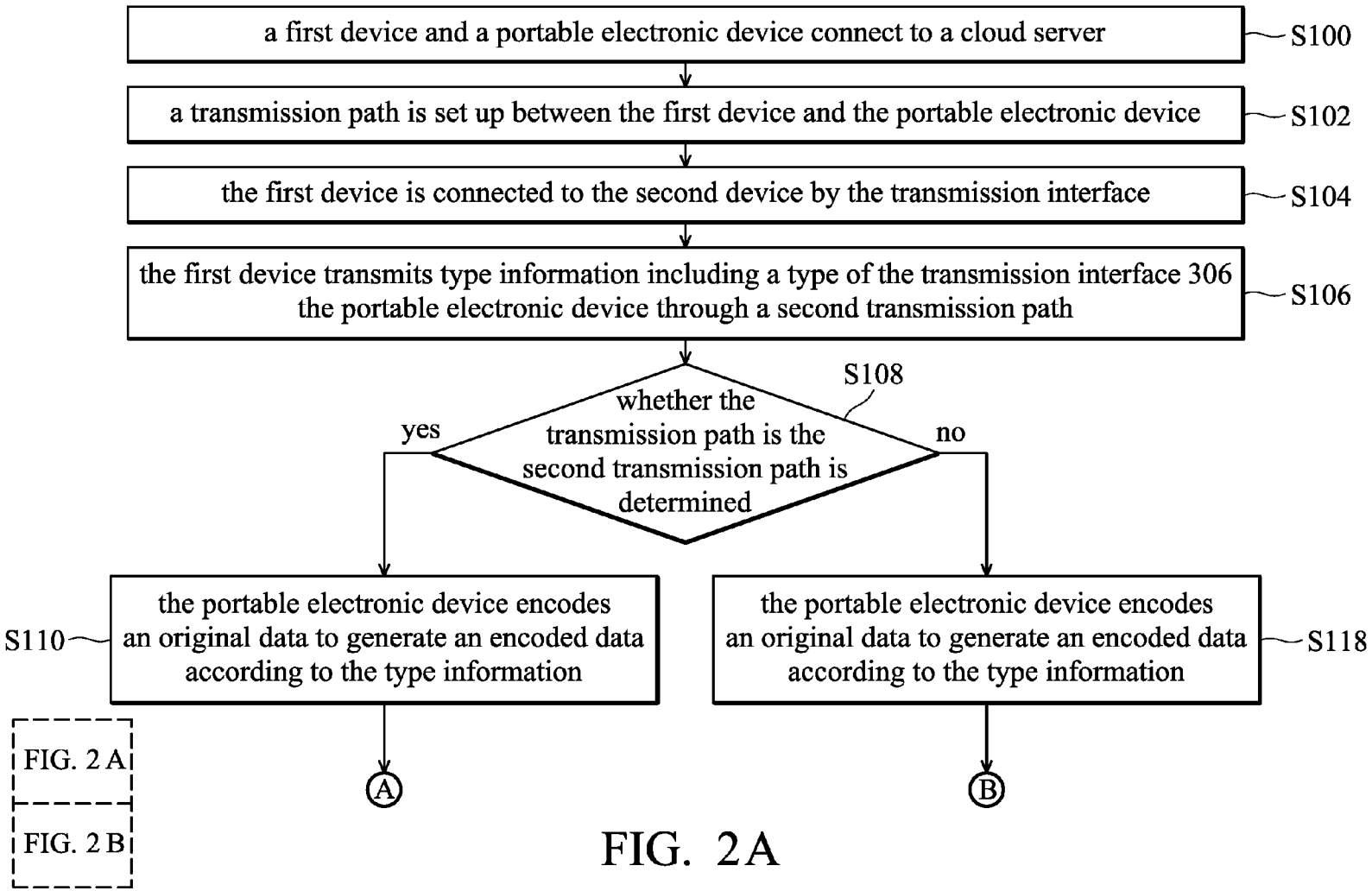
FIG. 2A and FIG. 2B are flow charts of a remote control method according to an embodiment of the present invention.
Figure 2B:
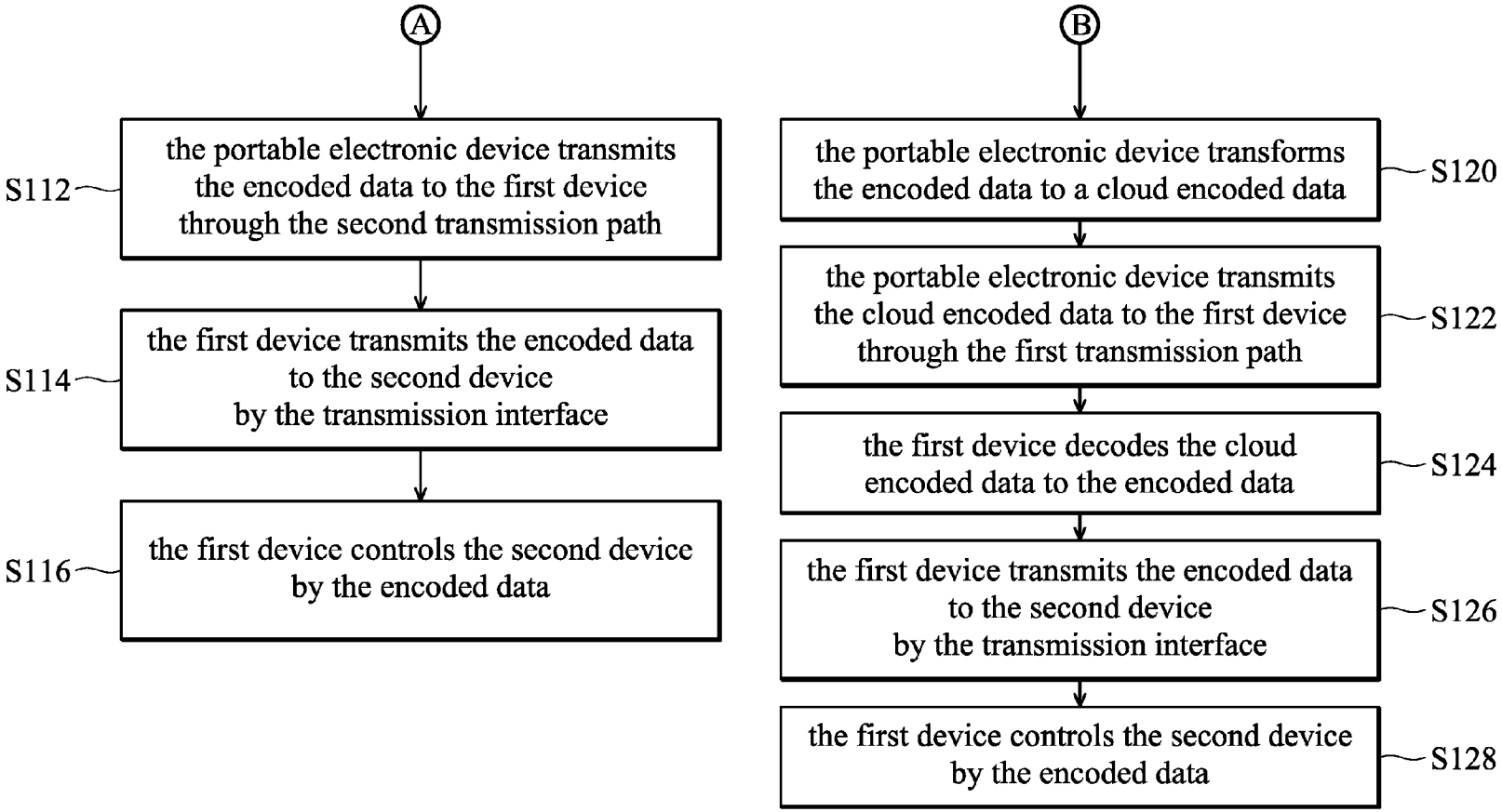

FIG. 2A and FIG. 2B are flow charts of a remote control method according to an embodiment of the present invention. In step S100, the first device 300 and the portable electronic device 400 connect to the cloud server 200. In step S102, the transmission path is set up between the first device 300 and the portable electronic device 400. The transmission path includes the first transmission path 601 implemented between the portable electronic device 400 and the first device 300 via the cloud server 200 or the second transmission path 602 implemented between the portable electronic device 400 and the first device 300 by peer to peer (P2P) technology.

In step 104, the first device 300 is connected to the second device 500 by the transmission interface 306. It is noted that step S104 can be performed before step S100. In step S106, the first device 300 transmits type information including the type of the transmission interface 306 to the portable electronic device 400 through the second transmission path 602. In Step S108, whether the transmission path is the second transmission path 602 is determined. If the transmission path is the second transmission path 602, step S110 is performed. If the transmission path is not the second transmission path 602, step S118 is performed. In step S110, when the transmission path is the second transmission path 602, the portable electronic device 400 encodes the original data to generate the encoded data conforming to the transmission interface 502 according to the type information. In step S112, the portable electronic device 400 transmits the encoded data to the first device 300 through the second transmission path 602. In step S114, the first device 300 transmits the encoded data to the second device 500 by the transmission interface 306. In step S116, the first device 300 controls the second device 500 by the encoded data, so that the second device 500 operates accordingly, such as turning on.

In step S118, when the transmission path is the first transmission path 601, the portable electronic device 400 encodes the original data to generate the encoded data according to the type information. In step S120, the portable electronic device 400 transforms the encoded data to the cloud encoded data in JavaScript Object Notation (JSON) format or eXtensible Markup Language (XML) format. In step S122, the portable electronic device 400 transmits the cloud encoded data to the first device 300 through the first transmission path 601. In step S124, the first device 300 decodes the cloud encoded data to the encoded data. In step S126, the first device 300 transmits the encoded data to the second device 500 by the transmission interface 306. Therefore, in step S128, the first device 300 controls the second device 500 by the encoded data, so that the second device 500 operates accordingly, such as turning on.

In contrast to the prior art, the present invention provides a remote control system 100 which includes a first device 300 and a second device 500. When the user connects the first device 300 to the second device 500, the second device 500, which originally could not connect to the Internet, can receive or transmit information to the cloud server 200 with assistance of the first device 300. The second device 500 can be an electronic product which cannot connect to the Internet in the user's house. The user can use the portable electronic device 400 to execute the first application 4061 and the second application 4063 to send corresponding encoded data to the first device 300, so as to control the second device 500. As a result, it achieves the purpose of remote control. Therefore, the present invention solves the problem of having to discard an electronic product that cannot connect to the Internet and replacing it with a new electronic product capable of connecting to the Internet, resulting in unnecessary waste.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A remote control system, comprising:

a cloud server;

a first device, comprising a transmission interface for connecting to a second device; and a portable electronic device, for setting up a transmission path to connect with the first device via the cloud server;

wherein the first device transmits type information including a type of the transmission interface to the portable electronic device through the transmission path, the portable electronic device encodes original data based on the type information to generate encoded data conforming to the transmission interface and transmits the encoded data to the first device through the transmission path, and the first device transmits the encoded data to the second device through the transmission interface, so as to control the second device.

2. The remote control system as claimed in claim 1, wherein the transmission interface comprises a RS232 port, a serial peripheral interface bus port, an inter-integrated circuit port, or a universal serial bus port.

3. The remote control system as claimed in claim 1, wherein the first device comprises a first wireless module and a microcontroller, the portable electronic device comprises a second wireless module, the microcontroller receives device information from the second device through the transmission interface, and the microcontroller controls the first wireless module to transmit the device information to the second wireless module of the portable electronic device through the transmission path.

4. The remote control system as claimed in claim 1, wherein the portable electronic device executes a first application and a second application, the first application is for transmitting the original data to the second application in inter process communication format, and the second application encodes the original data into the encoded data and transmits the encoded data to the first device through the transmission path.

5. The remote control system as claimed in claim 1, wherein the first device and the portable electronic device are logged in to the cloud server with same login information, so as to access a same cloud resource, and the login information comprises a login account and a login password corresponding to the login account.

6. The remote control system as claimed in claim 1, wherein the transmission path comprises a first transmission path implemented between the portable electronic device and the first device via the cloud server or a second transmission path implemented between the portable electronic device and the first device by peer to peer (P2P) technology.

7. An electronic device, comprises:

a transmission interface for connecting to an external device;

a microcontroller, connected to the transmission interface; and a wireless transmission module, for setting up a transmission path to connect with a portable electronic device;

wherein the wireless transmission module transmits type information including a type of the transmission interface to the portable electronic device by the transmission path, receives encoded data conforming to the transmission interface from the portable electronic device by the transmission path, and the microcontroller transmits the encoded data to the external device, so as to control the external device, wherein the portable electronic device encodes original data based on the type information to generate the encoded data.

8. The electronic device as claimed in claim 7, wherein the transmission path comprises a first transmission path implemented between the portable electronic device and the first device via a cloud server and a second transmission path implemented between the portable electronic device and the first device by peer to peer (P2P) technology.

9. The electronic device as claimed in claim 8, wherein the electronic device uses login information to log in to the cloud server, so as to access a cloud resource, and the login information comprises a login account and a login password corresponding to the login account.

10. The electronic device as claimed in claim 7, wherein the transmission interface comprises a RS232 port, a serial peripheral interface bus port, an inter-integrated circuit port, and/or a universal serial bus port.

11. A remote control method, applied to a first device, a second device and a portable electronic device, the remote control method comprising:

connecting the first device and the portable electronic device to a cloud server;

setting up a transmission path between the first device and the portable electronic device;

connecting the first device to the second device through a transmission interface of the first device;

transmitting type information including a type of the transmission interface to the portable electronic device through the transmission path by the first device;

encoding original data based on the type information to generate encoded data conforming to the transmission interface by the portable electronic device;

transmitting the encoded data to the first device through the transmission path by the portable electronic device;

transmitting, the encoded data to the second device through the transmission interface by the first device; and controlling the second device according to the encoded data.

12. The remote control method as claimed in claim 11, wherein the transmission path comprises a first transmission path implemented between the portable electronic device and the first device via the cloud server or a second transmission path implemented between the portable electronic device and the first device by peer to peer (P2P) technology.

13. The remote control method as claimed in claim 12, further comprising:

determining whether the transmission path is a second transmission path;

when the transmission path is the first transmission path, the portable electronic device transforms the encoded data to a cloud encoded data in JavaScript Object Notation (JSON) format or eXtensible Markup Language (XML) format;

transmitting the cloud encoded data to the first device through the first transmission path by the portable electronic device;

decoding the cloud encoded data to the encoded data by the first device;

transmitting the encoded data to the second device through the transmission interface by the first device; and controlling the second device according to the encoded data.

* * * * *